United States Patent [19]

Gallanis et al.

[11] 4,274,199

[45] Jun. 23, 1981

[54] ELECTRIC SHAVER

[75] Inventors: George P. Gallanis, Des Plaines; Albert R. Spohr, Park Ridge; Robert R. Lube, Countryside, all of Ill.

[73] Assignee: Sunbeam Corporation, Chicago, Ill.

[21] Appl. No.: 137,075

[22] Filed: Apr. 3, 1980

Related U.S. Application Data

[62] Division of Ser. No. 46, Feb. 2, 1979, Pat. No. 4,233,733.

[51] Int. Cl.[3] ..... B26B 19/00

[52] U.S. Cl. ..... 30/34.1

[58] Field of Search ..... 30/34.1, 90, 43.92

[56] References Cited

U.S. PATENT DOCUMENTS

| | | | |
|---|---|---|---|
| 3,148,447 | 9/1964 | Locke | 30/43.92 X |
| 3,328,542 | 6/1967 | Andrews | 30/34.1 |
| 3,995,368 | 12/1976 | Yamada et al. | 30/34.1 |
| 4,031,617 | 6/1977 | Tanaka et al. | 30/34.1 |
| 4,085,503 | 4/1978 | Beck et al. | 30/34.1 |

*Primary Examiner*—Jimmy C. Peters

*Attorney, Agent, or Firm*—George R. Clark; Neil M. Rose; Russell L. McIlwain

[57] ABSTRACT

A shaver includes a housing and a shaving head detachably secured to the housing. A modular cutting assembly is detachably mounted in the shaving head and includes a plurality of blades that are reciprocated within the head for cutting hair. The blades are joined together by pins and releasably secured to a mounting block. A biasing element secured between the mounting block and the blades biases the blades away from the mounting block to provide a floating connection. The mounting block is slideably positioned on a clip that is resiliently positioned within the shaving head. The shaver also includes a modular clipper assembly including a pair of blades reciprocally mounted within the shaving head. A clipper guard is slideably mounted in the housing for movement toward and away from the clipper blades and includes at least one sloped slot and a cutout portion with an inclined edge including at least one detent. A guard adjustment member is slideably mounted on the shaving head and includes a guide pin that is mounted within the slot and a detent pin member positioned to engage the inclined edge of the cutout and the detent defined thereon to vary the position of the guard.

16 Claims, 9 Drawing Figures

2
10
12
140
150
14
16
154
166
22
18
2

4
52
54
65
55
60
186
140
126
121
118
119
116
127
153
150
182
156
152
166
154
103
135
170
136
64
58
115
67
68
69
48
46
47
44
42
40
24
22
20
28
26
36
30
38
34
32
31
33

150
153
169
163
168
164
167
120
50
185
155
173
172
156
161
16
165
158
157
162
167
152
154
166
140
52
187
143
121
118
187
54
141
142
60
61
61
128
136
115
12
55
58
119
114
14
82
142
116
64
66
127
135
124
56
94
80
67
72
136
144
102
78
86
130
125
103
92
76
74
137
129
122
70
68
124
144
125
123
122
108
104
67
46
48
47
180
112
182
105
181
105
110
44
22
28
30
42
20
26
18

7
8

9
186
144
140
115
135
138
136
124
130
125
131
161
136
173
150
162
151
108
112
163
132
157
139
169
158
164
7
8
16
9

14
126
121
140
122
118
119
116
128
153
125
115
150
124
125
155
108
16

14
140
126
121
141
124
118
119
128
116
143
115
186
129
144
153
129
150
127
157
133
161
130
154
108
152
132
180
163
155

140
126
121
124
118
119
128
116
186
153
129
129
150
115
182
136
127
156
152
135
166
154
137
173
172
155
16
108

ELECTRIC SHAVER

This is a division of application Ser. No. 000,046 filed Jan. 2, 1979 now U.S. Pat. No. 4,233,733 issued Nov. 18, 1980.

BACKGROUND OF THE INVENTION

A. Field of the Invention

The device of the present invention relates to a new and improved shaver.

B. Description of the Prior Art

Electric dry shavers are widely used by men for short facial hair and are also used for trimming longer hair such as sideburns. Electric dry shavers for women are used for shaving underarm and leg hair. The requirements for performing these functions are quite different since women do not require a close shave in the underarm area which is particularly tender or sensitive while they demand close shaving on the legs. Accordingly, two different shaving modes or cutting assemblies are preferably provided for both men's and women's shavers.

A preferred feature of shavers of this type is ease in cleaning the different cutting assemblies thereby prolonging their usefulness. Also desirable is economy of assembly and manufacture. Many prior art shavers require the removal of the skin engaging comb to allow access to the shaving blades for cleaning. In addition, the blades of some prior art shavers are permanently secured within the shaver in multiple parts, thus increasing the difficulty of cleaning and replacement as well as increasing the cost of assembly and production.

Many prior art shavers include long hair cutter or trimmer blades mounted on the heat of the shaver at a position spaced from the short hair cutting blades. The long hair cutter blades are typically mounted on the head of the shaver as an appendage and this mounting is not sufficiently rigid to prevent twisting of the blades during use or misassembly of the blades in the head due to molding tolerances. As a result, the blades of the long hair trimmer are not in satisfactory shearing engagement and do not properly cut hair and may even cut the skin of the user.

Another desirable feature of electric shavers is that the blade for cutting the longer hair, such as sideburns, includes a guard to protect from cutting of the skin. Preferably, the guard is movable to various positions in accordance with the length of the hair and the sensitivity of the skin in the area of the hair to be shaved. Typical prior art shavers include a guard whose position relative to the blade is adjusted by a slide member that is mounted on the shaver and held in a selected position by friction, thus allowing the user of the shaver to position the guard at a desired location relative to the cutting blades. Friction serves to maintain the guard in the selected position until changed. A disadvantage of this type of guard position selection device is that the frictional holding force does not provide the user with a positive indication of position and may allow slipping of the guard due to vibrations of the shaver during use.

SUMMARY OF THE INVENTION

An object of the present invention is to provide a new and improved shaver.

Another object of the present invention is to provide a new and improved shaver that includes modular cutting components that are easy to manufacture and economical to assemble within the shaver.

A further object of the present invention is to provide a new and improved shaver that includes a cutting assembly that is easily positioned within the shaving head of the shaver and removed therefrom.

An additional object of the present invention is to provide a new and improved shaver that includes a guard for a clipper blade that is movable into several detent-determined positions and maintained in the selected position until again moved by the operator of the shaver.

It is another object of the present invention to provide a new and improved shaver that includes a modular long hair clipper that is assembled in a separate block and insertable into the head of the shaver to provide a precision long hair trimmer.

The present invention is directed to a new and improved shaver including a housing and a shaver head releasably secured to the housing. The head includes a skin engaging comb and a modular cutter assembly releasably mounted within the shaving head adjacent to the comb. The cutter assembly includes a plurality of cutting blades secured together by at least one pin and coupled to a motor. A blade mounting block is included on which are provided resilient spring arms that are releasably snapped over two of the pins thereby securing the blades to the blade mounting block. A biasing element is secured to the blade block and urges the blades away from the blade block to provide a floating effect to the blades.

The blade block is mounted on a mounting plate that includes a slot within which the block is slideably mounted. The slot is of a sufficient dimension to allow reciprocating motion of the block within the slot relative to the mounting plate. The mounting plate includes a clip and a hinge portion allowing the mounting block, the blades and the mounting plate to be hingedly and releasably mounted within the shaving head allowing their removal for cleaning. A similar type of mounting is disclosed in U.S. Pat. Nos. 3,376,636 and 3,386,167.

The shaver also includes a modular clipper assembly including a pair of clipper blades mounted in a separate block that is assembled in the shaving head and coupled to the motor positioned within the handle. Slideably mounted on the shaving head is a guard that may be positioned adjacent the clipper blades and whose position may be varied in accordance to the shaving conditions. The guard includes at least one inclined slot and a cutout portion including an inclined edge with at least one indentation or detent.

A guard position selection member is slideably mounted on the shaving head and includes at least one guide pin positioned within the slot and a detent pin positioned within the cutout portion and biased against the inclined edge and the indentations. In this manner, the guard adjustment member may be moved relative to the shaving head so that the guide pin slides along the slot of the guard varying the position of the guard relative to the clipper blades. In addition, the detent pin slides along the inclined edge and into the detent, thus defining a discrete position of the guard and the guard position selection member.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DETAILED DESCRIPTION OF THE PREFERRED EMBODIMENT

Figure 1:
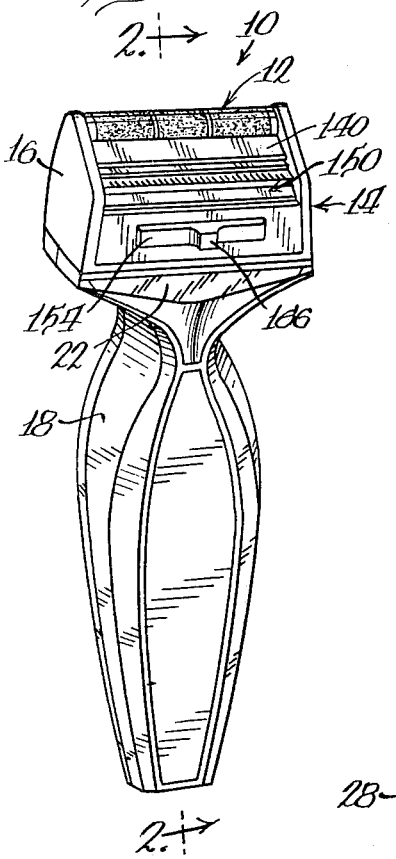
FIG. 1 is a perspective view of the shaver constructed in accordance with the principles of the present invention.

Referring now to the drawings and initially to FIG. 1, there is illustrated an electric shaver 10 of the type commonly known in the art as a dry shaver. Shaver 10 may be employed for shaving short and long hair and as illustrated, is a ladies' shaver; however, it is to be understood that the novel features of the shaver 10 may also be incorporated into a men's shaver.

Figure 2:
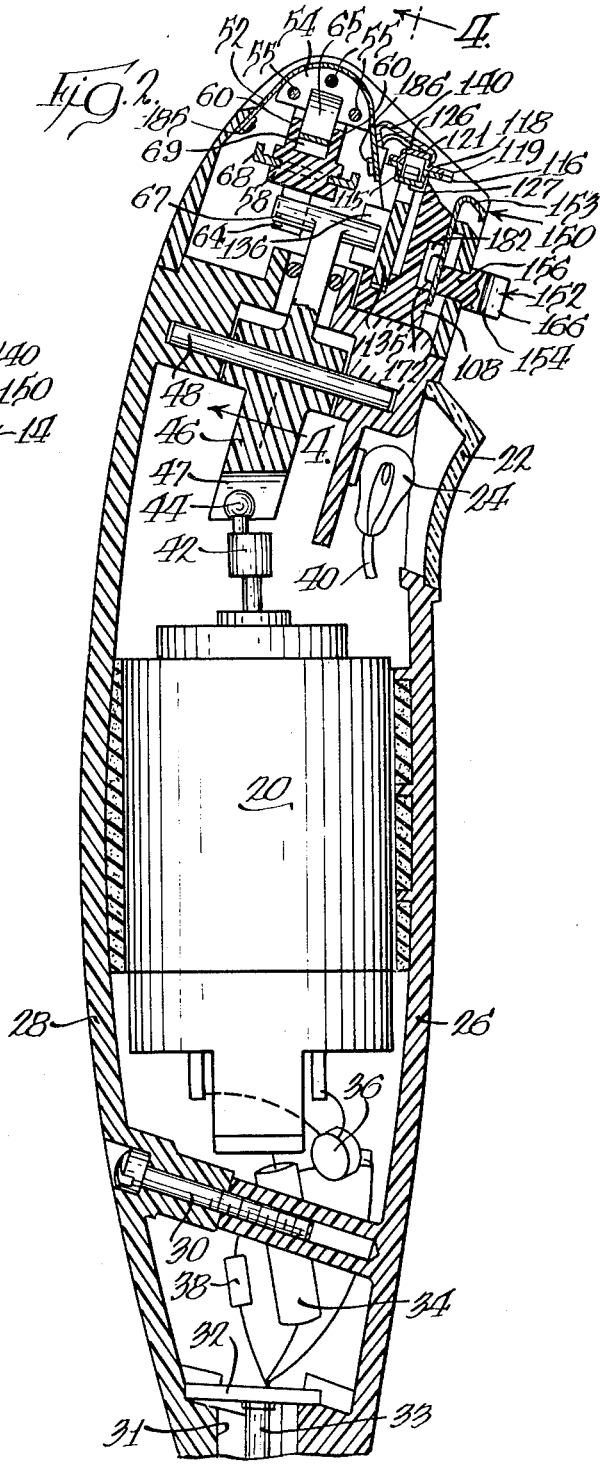
FIG. 2 is an enlarged cross-sectional view taken generally along line 2—2 of FIG. 1.
Figure 3:
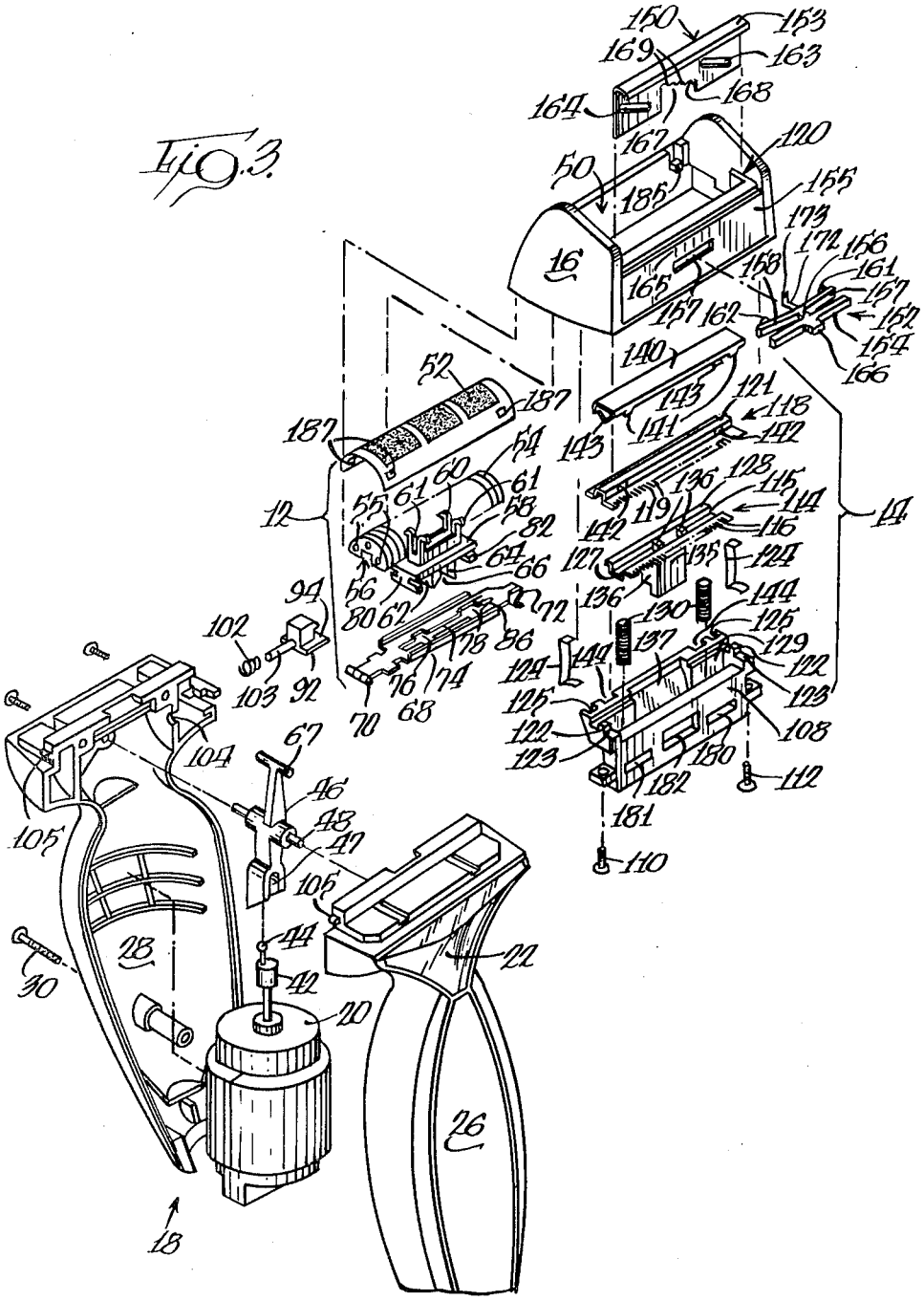
FIG. 3 is an exploded, perspective view of the shaver of the present invention.

The shaver 10 has a structural capability to shave short hair through the use of a modular cutter assembly generally designated by the reference numeral 12 (FIG. 3) and for shaving longer hair through the employment of a modular clipper assembly generally designated by the reference numeral 14 (FIG. 3). The cutter 12 and clipper 14 assemblies are defined in a shaving head 16 that is releasably secured to the body 18 of the shaver 10. The body of the shaver 18 functions as a handle to allow easy holding of the shaver 10 by the user and also defines a housing for a motor 20 (FIG. 2) that once energized, oscillates blades in the cutter 12 and clipper 14 assemblies. In the preferred embodiment illustrated, the housing or body 18 includes a lens 22 adjacent to a lamp 24 mounted in the housing 18 that is energized upon energization of the motor 20 so as to illuminate the area that is to be shaved.

The motor 20 and housing 18 will be briefly described with a more detailed description on the cutter 12 and clipper 14 assemblies being provided hereinafter. The housing 18 is defined by front 26 and rear 28 housings secured together by a fastener 30. The motor 20 is electrically coupled to a terminal board 32 through a rectifier 36 and a resistor 38. The lamp 24 is also connected to the terminal board 32 through a capacitor 34 by a conductor 40. The lower end of the housing 18 is provided with an opening or recess 31 which is closed at its inner end by the terminal board 32. A pair of electrical contact prongs 33 project from the terminal board 32 into the recess 31 for engagement by a female plug of a removable power cord (not shown) in a known manner.

In order to transmit the action of the motor 20 in the desired manner, a drive crank 42 is mechanically coupled to the armature shaft of the motor 20 and rotated thereby. The drive crank 42 includes a ball 44 that is positioned eccentrically with respect to the axis of rotation of the motor and that provides a driving connection to a drive arm 46. The drive arm 46 is pivotally mounted within the housing 18 intermediate its opposite ends on a pin 48 that extends through the drive arm 46 and is mounted within the housing 18. As is best shown in FIG. 3, the drive arm 46 is provided at its lower end with a slot 47 which engages the ball 44 in sliding contact therewith so as to translate the rotational motion of the motor 20 into an oscillatory motion of drive arm 46. As will be described below in detail, this motion of the drive arm 46 is correspondingly translated into a reciprocating motion of the cutter 12 and clipper 14 assemblies.

Considering now the modular cutter assembly 12, the assembly 12 is removably mounted near the upper or top portion of the shaving head 16. The shaving head 16 includes an open top 50 (FIG. 3) that is covered by a stamped comb or foil 52 that is intended to engage the skin. This comb 52 has a plurality of known-type openings or slits into which the hair to be shaved is received during sliding movement of the comb 52 over the skin. The hair passing through the comb 52 is then cut by a plurality of blades 54 that are positioned within the shaving head 16 adjacent the comb 52 and which reciprocate in close proximity to the inner surface of the comb 52. The blades 54 are positioned parallel to each other and maintained in uniformly spaced relationship with respect to one another by three parallel pins 55 which extend therethrough thereby forming a blade assembly, generally designated herein by reference numeral 56.

Figure 4:
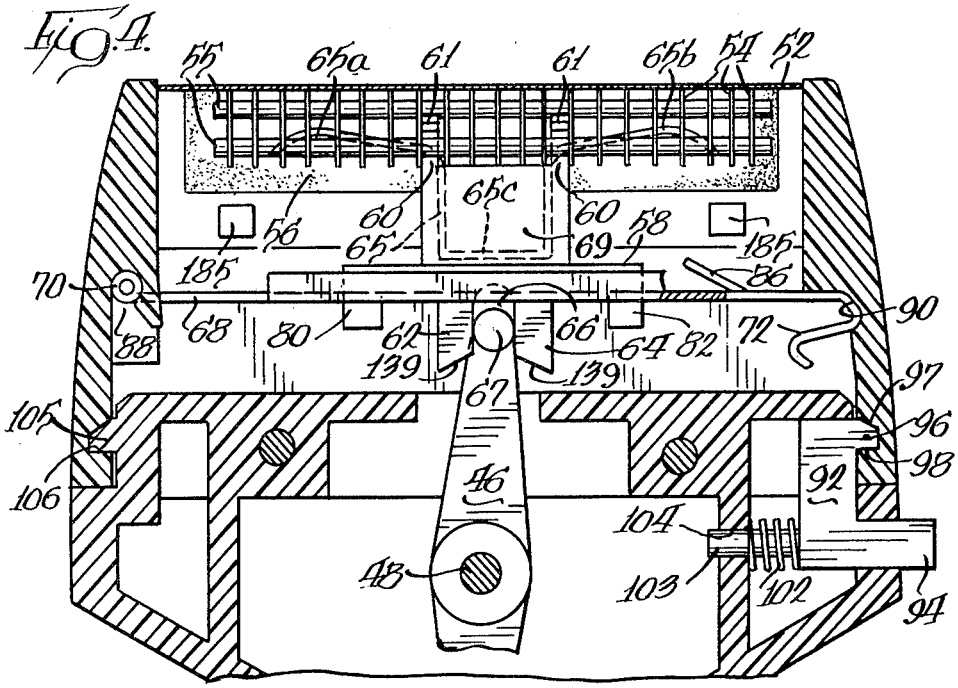
FIG. 4 is an enlarged view of the shaving head taken generally along line 4—4 of FIG. 2.

Blade assembly 56 is mounted for reciprocating movement within the shaving head 16 adjacent the comb 52 by a blade mounting block 58. The mounting block 58 is made of a low friction, resilient plastic material and includes, in the preferred embodiment, four upstanding arms 60, as best shown in FIGS. 2, 3 and 4. The upper ends of the arms 60 are molded to include hook-shaped stops 61 that extend upwardly between adjacent blades 54 and snap over two of the pins 55 (FIGS. 3 and 4) so as to maintain a releasable connection between the block 58 and the blade assembly 56. As best illustrated in FIG. 4, block 58 includes two downward extending legs 62 and 64 defining a slot 66 therebetween, within which an upper bar portion 67 of the drive arm 46 is positioned; thus providing the mechanical drive connection between the block 58 and the motor 20 allowing the block 58 to be reciprocated within the shaving head 16 in a known manner.

It is desirable for shaving comfort and a better shave that the blade assembly 56 floats relative to the shaving head 16 such that as the shaver 10 is moved over the skin of the user, comb 52 and blade assembly 56 move to conform to the surface being shaved. This floating arrangement of the blade assembly is facilitated by a spring, generally designated by the reference numeral 65, acting in cooperation with block 58.

Spring 65 is mounted in the block 58 and includes arms 65*a* and 65*b* that engage the underside of the blade assembly 56 biasing the blades 54 into engagement with the comb or foil 52. When the blade assembly 56 is not in engagement with the comb or foil 52, such as during removal of the modular cutter 12 for the purpose of cleaning or the like, the blade assembly 56 is restrained from becoming disassociated from the mounting block 58 by engagement of the blade-mounting pins 55 with the hook-shaped stops 61 of the block 58.

The spring 65 also includes a bent portion 65c that is U-shaped in configuration and, during assembly of the shaver 10, is inserted into a central cavity 69 defined in the block 58. Portion 65c thereby allows the spring 65 to be mounted in the block 58 while allowing the arms 65a and 65b to bias the blade assembly 56 in the desired manner.

To mount the block 58 for reciprocating movement within the shaving head 16, a mounting plate 68 (FIG. 3) is provided. The mounting plate 68 includes a first end 70 that is rolled upon itself to define a hinge member and a second end 72 that is S-shaped to define a clip. An elongated slot 74 is defined in the plate 68 and is further characterized by a first pair of aligned transverse slots 76 adjacent the hinge 70 and by a second pair of aligned transverse slots 78 defined adjacent the end 72. The block 58 is adapted to be mounted for relative slidable movement with respect to plate 68 within the slot 74 and includes, at its opposite ends, depending and inverted T-shaped extensions 80 and 82 that upon assembly of the block 58 to the plate 68 extend through the slot 74. To assemble the block 58 to the plate 68, the extensions 80 and 82 are first inserted downwardly through the slots 76 and 78 and then displaced to the left as viewed in FIG. 3. The portions of the plate 68 defining the lengthwise extending edges of the slot 74 are slidingly embraced on their upper and lower surfaces by slots 84 defined by the T-shaped extensions 80 and 82, as best shown in FIG. 3, thus providing a sliding connection of the mounting block 58 to the plate 68.

Once the block 58 is assembled to plate 68 as described above, an end stop member 86 that has been bent to a substantially perpendicular position relative to the plate 68 to permit assembly of block 58 thereto is bent to a substantially parallel position with the plate 68 so as to engage the right end of the block 58 and prevent the extensions 80 and 82 from being aligned with the transverse slots 76 and 78 and thus prevent removal of the block 58 from the slot 74.

To allow easy cleaning and reassembly of the shaving blades 54, the cutting assembly 12 is hingedly mounted within the shaving head 16 through the employment of the hinge member 70 and the clip 72 of the mounting plate 68. More specifically, the hinge member 70 is snapped into a downwardly opening slot 88 (FIG. 4) provided on the inner surface of the shaving head 16, and the clip 72 is snapped into a groove 90 also provided on an inner side surface of the shaving head 16. If it is desired to remove the cutting assembly 12 from the shaving head 16, the shaving head 16 is first removed from the body portion 18 and thereafter the clip 72 may be manually snapped out of the groove 90 and pivoted about the hinge member 70 for cleaning. If desired, the hinge 70 may be snapped out of the slot 88 and the entire cutting assembly 12 removed for replacement or more thorough cleaning.

The head 16 is easily removed from and repositioned on the body 18 through the employment of a movable latch member 92 (FIG. 4) that includes a button 94 extending outside of the housing 18. The latch member 92 also includes a hook 96 that is positionable within a slot 98 defined in the shaving head 16 and biased to that position by a helical spring 102 which is supported centrally along its longitudinal axis by an alignment pin 103. Alignment pin 103, which is preferably secured to the latch member 92, extends through a receiving aperture 104 formed in a portion of the body housing 18 of the shaver against which spring 102 is biased, thereby providing support for the latch member 92. If it is desired to remove the shaving head 16 from the body 18, the button 94 is pushed against the bias of the spring 102 until the hook 96 is moved out of engagement with the slot 98. Thereafter, the head 16 may be lifted off the body 18 of the shaver. The head 16 may be repositioned on the body 18 of the shaver without manual operation of the latch 92 by urging the head 16 into place against the biasing force of the latch 92 through an inclined upper edge surface 97 of the hook 96. A fixed latch member 105 is molded integral with the shaver body housing 18 in a position opposite the movable latch 92 and engages a slot 106 in the head 16 which is similar to slot 98, thereby firmly latching the head 16 in its assembled position on the shaver body 18.

Turning now to the clipper assembly 14 (FIG. 3), the clipper assembly 14 includes a mounting block 108 that is secured in the shaving head 16 by a pair of fasteners 110 and 112. Mounted for reciprocation within the block 108 is a clipper 114 including a clipper blade 115 having a plurality of cutting teeth 116 defined on a leading edge thereof. A stationary comb 118 is secured within the shaving head 16 at a forward position therein, generally indicated by reference numeral 120 in FIG. 3. Defined along a leading edge of the comb 118 are a plurality of hair-receiving teeth 119 which act in shearing cooperation with the cutting teeth 116 to provide the hair clipping function of the shaver 10. The comb 118 is fabricated so as to have an inverted U-shaped channel 121 running longitudinally therewith. The channel 121 lends rigidity to the comb 118 and, in addition, cooperates with upwardly extending projections 122 molded integral with the mounting block 108, thereby serving to locate the comb 118 for fixed positioning on a pair of side shoulders 123 provided on the mounting block 108. In order to secure the clipper comb 118 on the block 108 in shearing engagement above the blade 115, there are provided C-shaped clips 124 that are received by outwardly facing channels 125 provided in the rear surface of the mounting block 108 at opposite ends thereof. When the clipper comb 118 has been positioned on the mounting block 108 over the projections 122 during assembly, the clips 124 are inserted in their respective channels 125 and pressed into overlapping engagement with a longitudinal depression 126 in the comb channel 121. Thus, the comb 118 is caused to be firmly supported by and secured against the shoulders 123 of the mounting block 108.

Figure 6:
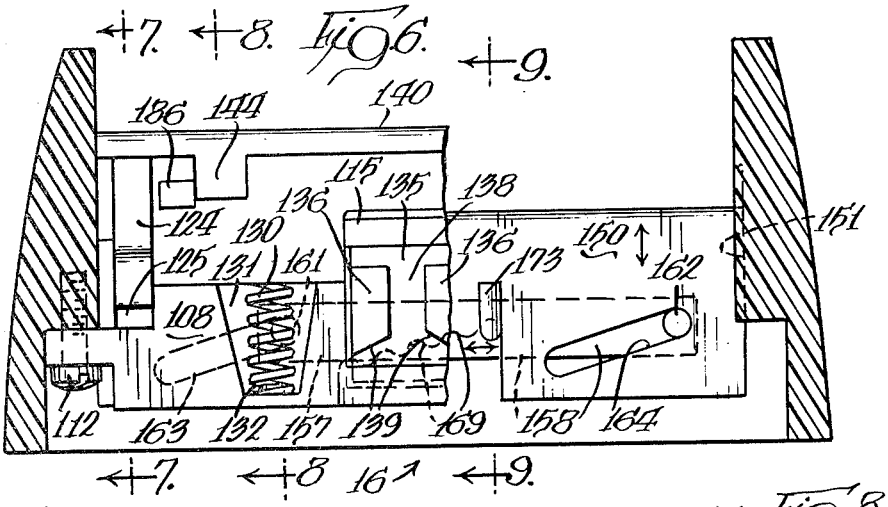
FIG. 6 is a vertical sectional view taken generally along line 6—6 of FIG. 5 with a portion of the clipper mounting block broken away.
Figure 7:
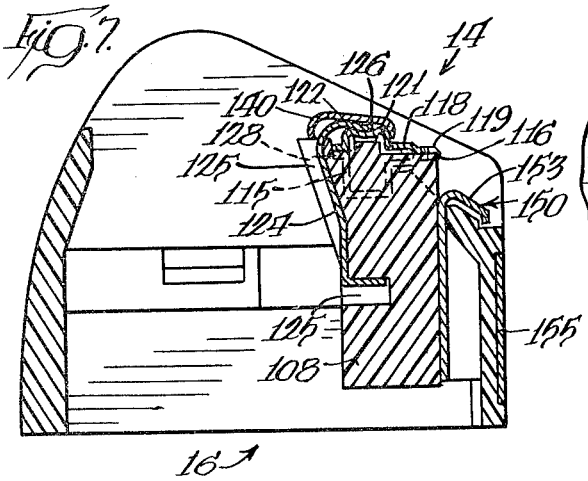
FIG. 7 is a vertical sectional view taken generally along line 7—7 of FIG. 6.
Figure 8:
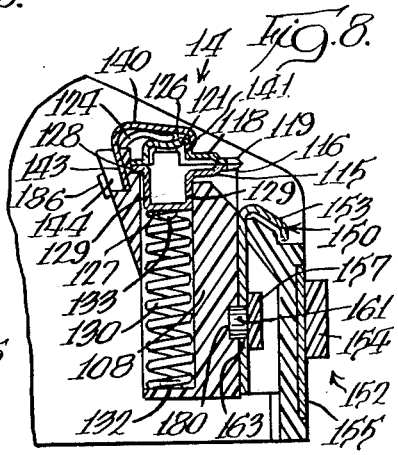
FIG. 8 is a partial vertical sectional view taken generally along line 8—8 of FIG. 6.

It will be appreciated that in order to achieve desirable clipping performance with the use of a reciprocating cutter system, such as in the instant invention, it is necessary that the clipper blade be rigidly constructed and biased into close cooperation with its associated comb. Thus, in accordance with the instant invention and as best illustrated in FIGS. 2, 3, 7 and 8, the clipper blade 115 is fabricated having a central U-shaped channel 127 running longitudinally therewith in order to achieve the desired rigidity and the cutting teeth 116 as well as a rear flange-like surface 128 of the clipper blade 115 are ground to a uniform flatness in order that the clipper blade 115 may act in close engagement with the comb 118. The clipper blade is guided for reciprocation within the mounting block 108 by inner wall portions, generally designated by reference numeral 129, of the mounting block 108. Biasing of the clipper blade 115 against the comb 118 is provided by a pair of helical springs 130 which are disposed in interior recesses 131 in the mounting block 108, as best shown in FIGS. 6 and 8. At the bottom of each recess 131 is a molded projection 132 (FIG. 8) which serves to locate the lower end of each respective spring 130. To position each spring 130 in a suitable biasing relationship with the clipper blade 115, there is provided a pair of projections 133 extending downwardly from the underside of the clipper blade channel 127, as viewed in FIG. 8.

Figure 9:
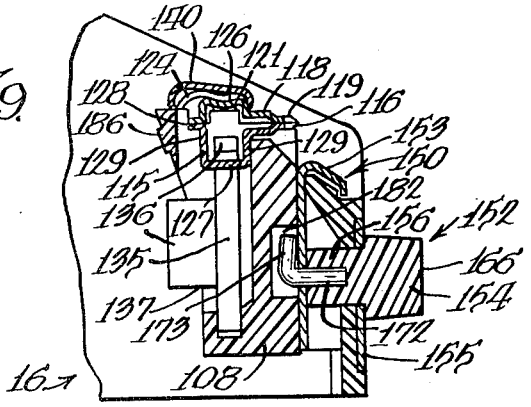
FIG. 9 is a partial vertical sectional view taken generally along line 9—9 of FIG. 6.

For the purpose of providing the clipper 114 with a driving connection to the drive arm 46, and in turn the motor 20, the clipper 114 includes a drive block 135. As viewed in FIGS. 2, 3 and 9, the drive block 135 is attached by suitable lugs 136 to the underside of the channel 127 of the clipper blade 115 and extends downwardly within the mounting block 108. A generally rectangular opening 137 in the mounting block 108 permits access to the drive block 135 by the drive arm 46. In order to transmit the oscillatory motion of the drive arm 46 into a reciprocating motion of the clipper 114, the drive block 135 includes rearward extensions 136 (FIG. 2) that protrude through the opening 137 in the mounting block 108 and define a vertical slot 138 (FIG. 6). The end of the bar portion 67 of the drive arm 46 opposite the end which is in driving engagement in slot 66 of the cutter drive block 58 is engaged in sliding contact in the slot 138 of the clipper drive block 135.

With further reference to the slots 66 and 138, it will be appreciated that as cleaning of the shaver mechanisms is performed, the drive block 58 of the shaver or cutter assembly 12 and the drive block 135 of the clipper assembly 14 are likely to be moved laterally from their initial positions and hence will be misaligned with respect to the bar portion 67 of the drive arm 46 upon reassembly of the shaving head 16. This misalignment, which could make it difficult to reinstall the shaving head 16, is overcome in the instant invention by providing the slots 66 and 138 of the shaver drive block 58 and clipper drive block 135, respectively, with flared lead-in portions 139. Accordingly, regardless of the particular lateral positions of the shaver drive block 58 and clipper drive block 135, each block will be moved into proper alignment for engagement with the two ends of the bar portion 67 of the drive arm 46 as the shaving head 16 is repositioned into place, obviating the need for manual adjustment of the blocks 58 and 135.

As is seen from FIG. 1, the short hair cutter area 12 and the clipper area 14 of the shaving head 16 are generally constructed so as to be spaced with respect to one another and thus, in order to provide for a transitional surface member between these areas, the shaving head 16 is constructed to include a cover plate 140. Defined along an edge of the cover plate 140 are integral tabs 141 which are engageable in corresponding apertures 142 provided in the clipper comb 118. Along an opposite edge of the cover plate 140 are similar integral tabs 143 which are engageable in slots 144 that are provided in the upper rear edge of the clipper mounting block 108. In this manner, the cover plate 140 is firmly attached to the shaving head 16 and thereby serves primarily to prevent insertion of foreign material into the shaving head 16.

Different degrees of shaving can be accomplished by the clipper blade 115 through the use of a clipper blade guard 150 that is slideably mounted at its opposite side edges in vertical slots 151 formed in the inner surface of the side walls of the shaving head 16 rearwardly of the front walls thereof, as shown in FIG. 6. The guard 150, which is characterized by a forwardly and downwardly inclined upper edge 153, is slideable in a generally vertical plane from a position adjacent the clipper blade 115 (FIG. 2) to an extreme position (FIG. 7) spaced from the blade 115 whereby to provide greater access to the blade 115 by hair to be cut. The vertical position of the clipper guard 150 is varied through the use of a slide button actuator assembly, generally designated by the reference numeral 152. The slide button assembly 152 includes a finger engaging portion 154 that slides in a generally horizontal motion in abutment with a trim plate or outer front surface 155 of the shaving head 16. The slide button 152 includes a stem portion 156 that extends through an aperture or slot 157 defined in the trim plate 155. Integrally defined on the stem portion 155 inwardly of the front wall of the shaving head 16 are resilient spring arms 157 and 158. In the preferred embodiment the slide button 152 is fabricated of a resilient material such as plastic. Defined on the outer extreme ends of the spring arms 157 and 158 are guide pins or buttons 161 and 162, respectively, the function of which is described below in detail.

To provide for a connection between the clipper guard 150 and the slide button assembly 152 in a manner which accomplishes the vertical adjustment of the clipper guard by a selective horizontal movement of the finger engaging portion 134 of the slide button assembly 152, the clipper guard plate 150 is provided with two spaced inclined or sloped slots 163 and 164. When the clipper guard 150 and slide button 152 are assembled in the shaving head 116, the buttons 161 and 162 each extend through the inclined slots 163 and 164, respectively. In this manner, if the slide button 152 is moved horizontally across the trim plate 155 in one direction, engagement of the buttons 161 and 162 with the upper edges of the slots 163 and 164 causes an upward vertical movement of the guard plate 150. Conversely, horizontal movement of the slide button 152 in the opposite direction results in engagement of the buttons 161 and 162 with the lower edges of the slots 163 and 164 and downward movement of the guard plate 150. Thus, horizontal movement of the slide button 152 imparts either upward or downward vertical movement to the guard plate 150 thereby varying the position of the guard relative to the clipper blade 115. Indicia 165 are included on the trim plate 155 and the finger engaging portion of the slide button assembly 150 includes an indicating extension 166 that may be positioned adjacent one of the indicia 165 to indicate the position of the guard 150 relative to the clipper blade 115.

In the preferred embodiment illustrated, it is desirable that several incremental or discrete positions of the guard plate 150 relative to the clipper blade 115 be provided. Thus in accordance with the instant invention there is provided, as best shown in FIGS. 3 and 6, a cutout portion 167 in the lower edge of the blade guard 150 including an upper inclined edge 168 having a plurality of indentations or detents 169 defined thereon. This inclined edge 168 is engaged by a rigid pin 172, preferably of metal construction, secured in the stem portion 156 of the slide button assembly 152 and extending rearwardly into the shaving head 16. When the guard 150 and indicating slide button 152 are assembled, the pin 172 is in a position to engage the inclined edge 168. As the slide button assembly 152 is moved horizontally, the rigid pin 172 slides along the edge 168 positively engaging each indentation 169 and providing a definite stop that the operator can feel. These indentations or detents 169 correspond to the different indicia 165 and thus define discrete positions of the guard plate 150 relative to the clipper blade 115.

It will be appreciated from the description which follows and from particular reference to FIGS. 2 and 3, that the definite stop effect felt by the operator in adjustment of the clipper blade guard 150 position is attributable to a predetermined biasing relationship between the blade guard 150 and the slide button assembly 152. As the blade guard 150 is assembled within the shaving head 16, spring arm 157 or 158 of the slide button assembly 152 is first inserted through the slot 157 of the trim plate 158 and each of the buttons 161 and 162 is then aligned with its corresponding inclined slot 163 and 164, respectively, in the blade guard 150. Thereupon, the rigid pin 172 is press-fit into a blind hole in the stem portion 156 of the slide button assembly 152 and the blade guard 150 moved into abutment with spring arms 157 and 158, each button 161 and 162 thereby extended through its respective slot 163 and 164 in the blade guard 150. Owing principally to the relative positioning of the inclined slots 163 and 164 with respect to the cutout portion 167 of the blade guard 150, the pin 172 can only be inserted into position after first applying a slight upward pressure to the slide button assembly 152, which pressure is opposed by the biasing force of the resilient spring arms 157 and 158 as buttons 161 and 162 engage the upper edges of slots 163 and 164. When pin 172 is fully inserted, this biasing force of the spring arms 157, 158 remains operative to provide the discrete stop effect felt by the operator as the clipper blade guard 150 is selectively adjusted. The pin 172 is fabricated with a hook-shaped terminus portion 173 which abuts the back side of the blade guard 150, as viewed in FIGS. 3 and 9, for example, thereby preventing the blade guard 150 from becoming disassociated from the slide button assembly 152 during normal operation of the shaver.

Figure 5:
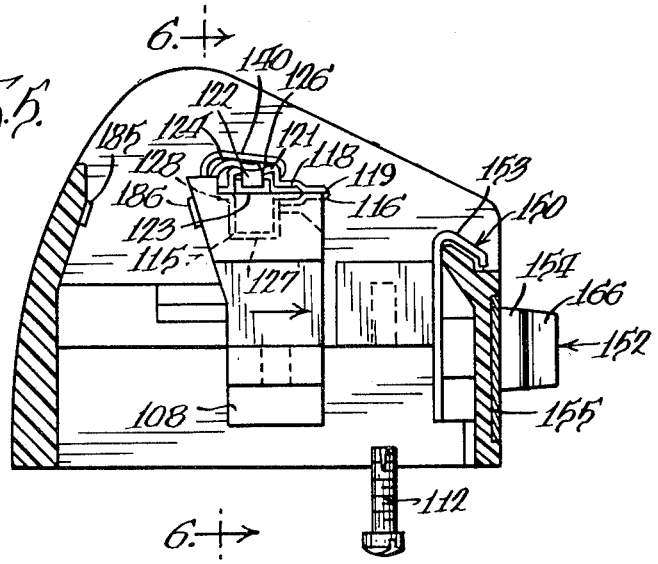
FIG. 5 is a cross-sectional view of the shaving head of the present invention.

It should be understood from the foregoing description that the shaving head 16 is easily assembled, inasmuch as the short hair cutter 12 and the clipper 14 are both preassembled as separate modules. In this connection, once the blade guard 150 and slide button actuator 152 are mounted within the shaving head 16 in the manner described above, the clipper 14 may then be positioned within the shaving head 16 with a horizontal motion, as illustrated in FIG. 5, and fastened into place. Rectangular openings 180, 181, and 182 in the clipper blade mounting block 108 permit the spring arm buttons 161, 162 as well as the pin 172 of the blade guard actuator assembly 152 to extend slightly within the block 108, thereby allowing the clipper assembly 14 to be moved into close parallel relationship with the clipper blade guard 150 providing additional support therefor. After this assembly operation is performed, the comb or foil 52 for the short hair cutter assembly 12 may then be mounted in the shaving head 16 on suitable pairs of supporting pins 185 and 186 which are provided on the shaving head 12 and clipper block 108, respectively, engaging corresponding apertures 187 in the comb or foil 52. The short hair cutter assembly 12 may then be installed in the manner described herein, and the complete shaving head 16 may be positioned onto the body 18 of the shaver 10 in preparation for shaver use.

While only a single embodiment of the present invention has been shown, it will be understood that various changes and modifications may occur to those skilled in the art and it is contemplated by the appended claims to cover all such changes and modifications as fall within the true spirit and scope of the present invention.

What is claimed as new and desired to be secured by Letters Patent of the United States is:

1. A shaver comprising a housing, a shaving head removably mounted on said housing, a clipper assembly mounted in said shaving head, drive means mounted in said housing for driving said clipper assembly, said clipper assembly including a movable cutting blade reciprocated by said drive means and a guard assembly adjacent said blade, said guard assembly including a clipper guard slideably mounted in said shaving head for movement toward and away from said blade, a slide member slideably mounted on said shaving head, said clipper guard including an elongated, sloped slot and a cut-away portion with an inclined edge, said inclined edge including at least one indentation, said slide member including at least one spring arm having a button slideably positioned in said sloped slot and a pin mounted in said slide member and biased against said inclined edge.

2. The shaver of claim 1 wherein said slide member and said spring arm are fabricated of a resilient plastic material and said pin is fabricated of a rigid material.

3. The shaver of claim 1 wherein said clipper guard includes a second sloped slot spaced from said first slot and said slide member includes a second spring arm spaced from said first arm and slideably positioned in said second slot.

4. A shaver comprising a housing defining the body of said shaver, a shaving head releasably mounted on said housing, a modular cutter assembly removably mounted in said head for cutting hair, said cutter assembly including a plurality of cutting blades, a blade mounting block for releasably mounting said blades in said cutter assembly, a mounting plate for said block including first and second ends, said first end defining resilient latch means for latching said plate in said head, said second end defining hinge means for allowing a hinge connection of said plate in said head, a modular clipper assembly mounted in said head for clipping hair, said clipper assembly including a blade and a comb slideably engaging one another and a guard plate movably mounted on said head for movement relative to said blade, said guard plate including at least one sloped slot and a cut-out portion with an inclined edge, said edge including at least one indentation, a guard positioning member slideably mounted in said head, said positioning member including at least one spring arm having a button engaging said slot for movement therein, said positioning member also including a pin positioned against and slideable along said edge, and means for reciprocating said cutter and clipper blades.

5. The shaver claimed in claim 4 wherein said cutter blades are mounted on at least one pin, said blade mounting block including at least one hooked arm for engagement over said pin to releasably secure said cutter blades to said block.

6. The shaver claimed in claim 4 wherein said mounting plate includes a slot, said mounting block being slideably mounted in said slot.

7. The shaver claimed in claim 6 wherein said mounting plate includes a stop member in said slot, said stop member being movable to a first position to allow insertion of said mounting block into said slot and to a second position to prevent removal of said mounting block from said slot.

8. The shaver claimed in claim 4 wherein said guard plate includes a second sloped slot and said positioning member includes a second arm having a button engaging said second slot for movement therein.

9. The shaver claimed in claim 4 wherein said clipper assembly includes a clipper blade housing and at least one helical spring, said spring including a first end seated against said blade housing and a second end seated against said clipper blade for reciprocation therewith.

10. A shaver for cutting hair comprising a housing defining the body of said shaver, a shaving head releasably mounted on said housing, a modular short hair cutter assembly mounted in said shaving head, a modular long hair clipper assembly mounted in said shaving head including a mounting block, a clipper blade mounted for reciprocating movement in said block, and a comb mounted in said block adjacent said blade, said clipper assembly being removable from said shaving head independently of said modular short hair cutter assembly.

11. The shaver claimed in claim 10 further comprising a biasing member mounted in said block and engaging said blade to bias said blade into engagement with said comb.

12. The shaver claimed in claim 10 further comprising a blade mounting member on which said blade is mounted, and means for reciprocating said blade, said mounting block including an opening through which said reciprocating means extends to engage said mounting member and reciprocate said blade relative to said block.

13. A shaver comprising a shaver body and a shaving head detachably mounted on said shaver body, said shaving head including a pair of spaced side walls and a pair of end walls forming a frame having a large central opening, a modular short-hair cutter assembly and a cooperating flexible skin-engaging comb removably mounted within said frame, said modular cutter assembly including a plurality of cutting blades, said frame supporting said cutter assembly with said cutting blades in shearing engagement with said flexible skin-engaging comb a modular long-hair clipper assembly removably mounted within said frame, said clipper assembly including an elongated mounting block for supporting a clipper blade for reciprocating movement and a clipper comb fixedly thereon, said mounting block being positioned within said frame opening and connected to at least two of said walls, said mounting block and said frame including means for supporting said flexible comb in a generally arcuate configuration within said opening with spaced parallel edges of said comb being connected one to said frame and one to said mounting block.

14. The shaver of claim 13 wherein said mounting block is formed with a lengthwise extending recess within which said clipper blade is supported for reciprocating movement, means securing said clipper comb to said mounting block in position overlying said clipper blade and said recess, and spring means received in said recess for biasing said clipper blade into shearing engagement with said clipper comb.

15. The shaver of claim 14 wherein said securing means comprises a clamp having a body portion and end portions connected thereto, one of said end portions engaging said mounting block and another of said end portions engaging said clipper comb, said mounting block being formed with a channel for receiving said body portion and limiting movement of said clamp lengthwise of said block.

16. The shaver of claim 13 wherein said shaving head includes an adjustable guard assembly having a guard plate extending lengthwise of said clipper comb and said clipper blade and movable between a first position in proximity with said clipper comb and a second position removed from said clipper comb, said guard assembly including an actuator for selective adjustment of said guard plate, said actuator being mounted on said frame for slidable movement in said lengthwise direction and having a projection portion extending through said guard plate for adjusting said guard plate, said guard plate being positioned between said frame and said mounting block within said shaving head and supported in slidable contact with said mounting block, said mounting block further comprising a lengthwise extending recess for matingly receiving said projection portion of said actuator.

* * * * *